United States Patent [19]

Pozzobon et al.

[11] Patent Number: 4,680,878

[45] Date of Patent: Jul. 21, 1987

[54] SKI BOOT

[75] Inventors: Alessandro Pozzobon, Treviso; Giorgio Baggio, San Martino di Lupari, both of Italy

[73] Assignee: Nordica S.p.A., Montebelluna, Italy

[21] Appl. No.: 857,037

[22] Filed: Apr. 28, 1986

[30] Foreign Application Priority Data

May 6, 1985 [IT] Italy ..... 20575 A/85

[51] Int. Cl.[4] ..... A43B 5/04; A43C 11/00

[52] U.S. Cl. ..... 36/117; 36/50; 24/68 B; 24/68 SK

[58] Field of Search ..... 36/117–121, 36/50; 24/68 SK, 69 SK, 70 SK, 71 SK, 68 B, 71.2

[56] References Cited

U.S. PATENT DOCUMENTS

| | | | |
|---|---|---|---|
| 967,601 | 8/1910 | Bovard | 24/68 B |
| 4,433,456 | 2/1984 | Baggio | 24/68 SK |
| 4,596,080 | 6/1986 | Benoit et al. | 36/120 |
| 4,616,524 | 10/1986 | Bidoia | 36/120 X |

FOREIGN PATENT DOCUMENTS

| | | | |
|---|---|---|---|
| 3247516 | 6/1984 | Fed. Rep. of Germany | 36/117 |
| 3502522 | 8/1985 | Fed. Rep. of Germany | 36/117 |
| 2570257 | 3/1986 | France | 36/119 |
| 2572258 | 5/1986 | France | 36/119 |

*Primary Examiner*—James Kee Chi

*Attorney, Agent, or Firm*—Guido Modiano; Albert Josif

[57] ABSTRACT

This ski boot comprises a boot shell having a front gaiter and a rear gaiter associated therewith, as well as a lever element which is pivoted at one end to either of said gaiters, preferably the rear gaiter, for rotation about the pivot axis. Journalled to a middle portion of the lever element is an adjustment assembly for adjusting the working length of a pair of cables which are attached with the other ends thereof to the other gaiter, e.g. the front gaiter, at a point away from the pivot axis. The lever element may be moved to an open position, whereat said adjustment assembly is made accessible for operation and the working length of the cables can be adjusted without pulling them, and to a closed position, whereat the cables tighten the gaiters against each other, and the adjustment assembly cannot be reached from the outside.

17 Claims, 10 Drawing Figures

SKI BOOT

BACKGROUND OF THE INVENTION

This invention relates to a ski boot, in particular of the rear entrance type.

As is known, ski boots of the so-called rear entrance type comprise essentially a boot shell whereto front and rear gaiters are journalled which are juxtaposed to each other; the boot is fastened or closed by tightening the gaiters against each other.

For gaiter closing, various devices are currently in use among which devices comprising cables attached to either of the gaiters, e.g. the front gaiter, and to a take-up assembly on the rear gaiter which is operative to take up or pay off the cables, thereby the working length of the cables can be changed to switch from the closed condition to the open condition, and/or vice versa.

With such devices, which are quite convenient to use as a rule, the gaiters are tightened by pulling on the cable through an actuator assembly formed, for example, by a cylindrical body around which the cables are wound.

Consequently, as the tightening force to be applied increases, a larger effort is to be exerted on the cable take-up assembly, which causes some practical difficulties due especially to the fact that the operation is mostly performed with gloves or even mittens on.

SUMMARY OF THE INVENTION

It is the aim of this invention to solve the above problem by providing a ski boot wherein the gaiters can be tightened by means of cables without requiring any special effort during the cable take-up stage to shorten their working length, while still producing an adequate tightening force.

Within the above aim it is a particular object of this invention to provide a ski boot which allows quick and simple opening and closing operations.

Another object of this invention is to provide a ski boot wherein the gaiters, additionally to the closed position, can also be set at an intermediate position where they are held relatively apart to permit a comfortable walking with the boot on.

A not least object of this invention is to provide a ski boot incorporating a gaiter closure device which has a simplified construction and allows all of the operations involved to be performed in a simple and quick manner.

The above aim, and these and other objects to become apparent hereinafter, are achieved by a ski boot, comprising a boot shell wherewith there are associated a front gaiter and a rear gaiter, characterized in that it comprises a lever element pivoted at one end to either of said gaiters for rotation about the pivot axis, said lever element carrying, at a middle portion thereof, an adjustment assembly for adjusting the working length of at least one cable attached with the other end to the other of said gaiters at a point away from said pivot axis, said lever being movable to an open position, whereat said adjustment assembly is made accessible for operation, and to a closed position, whereat said at least one cable holds said gaiter tight against each other.

BRIEF DESCRIPTION OF THE DRAWINGS

Further features and advantages will become apparent from the following description of a preferred but not exclusive embodiment of a ski boot according to the invention, as shown by way of illustration and not of limitation in the accompanying drawings, where.

DESCRIPTION OF A PREFERRED EMBODIMENT

Figure 3:
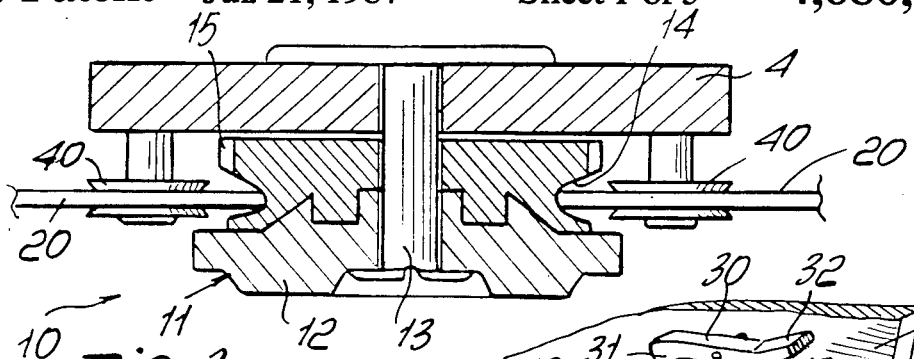
FIG. 3 is a sectional view of the adjustment assembly.
Figure 2:
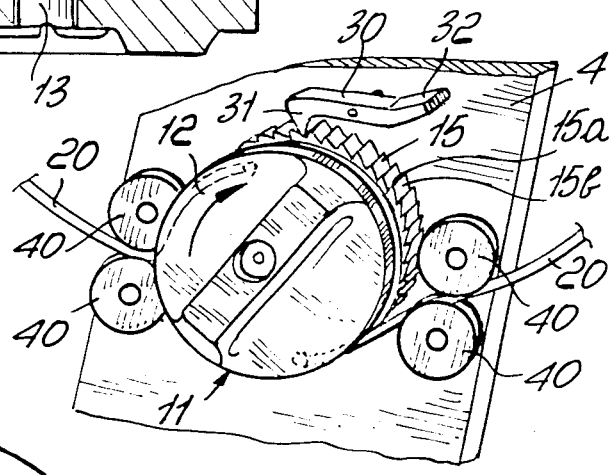
FIG. 2 details in a perspective view the adjustment assembly for adjusting the working length of the cables.
Figure 1:
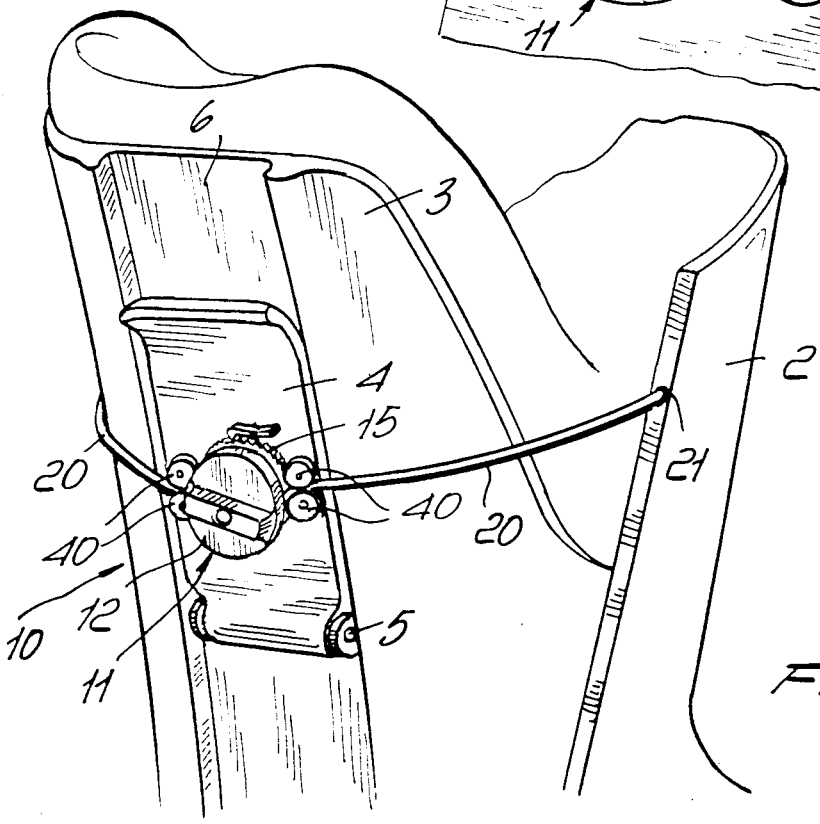
FIG. 1 is a diagrammatic perspective view of the upper part of the ski boot gaiters.

With reference to the drawing figures, the ski boot according to the invention comprises a boot shell 1 as well as a front gaiter 2 and a rear gaiter 3 which are attached to the shell 1 in a manner known per se and juxtaposed to each other. The ski boot defines a longitudinal direction L (FIG. 4) pointing from the heel portion to the toe portion of the boot a widthwise direction W (FIG. 8) pointing from one side of the boot to the other, and an upwards direction U pointing upwards from the sole of the boot.

Figure 7:
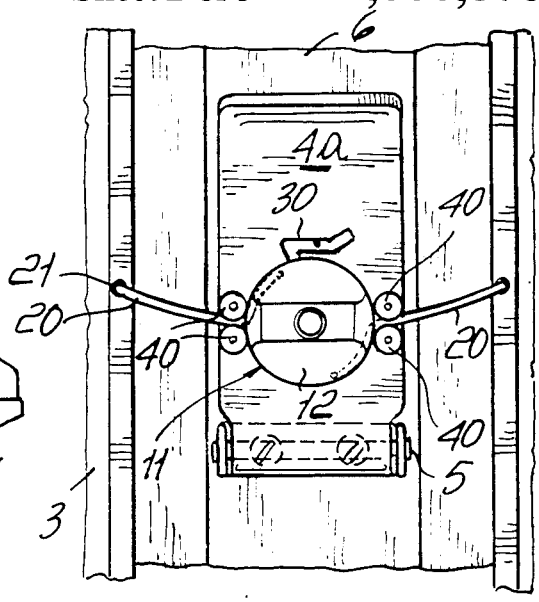
FIG. 7 shows diagrammatically in front elevation the lever element in the open position.
Figure 8:
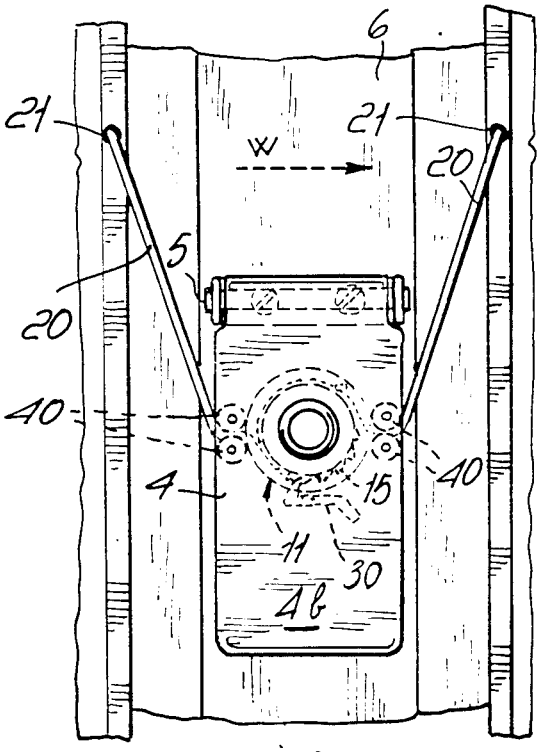
FIG. 8 shows the lever element in the closed position.

To one of the gaiters, preferably to the rear gaiter 3, there is pivoted a lever 4 which is connected with one end to a pivot 5 preferably, but not necessarily, housed within an articulation area or depression 6 defined longitudinally in the rear gaiter 3. The lever 4 has a first face 4*a* (FIG. 7) and a second face 4*b*, opposite thereto (FIG. 8). As visible in FIGS. 7 and 8, when lever 4 is in an open position (FIG. 7) the face 4*b* of the lever faces the articulation area 6 and when leyer 4 is in a closed position (FIG. 8) the face 4*a* faces the articulation area 6.

The pivot 5, which extends crosswise to the longitudinal direction of the gaiter, defines an articulation means and a pivot or rotation axis for the lever 4. As visible in the drawing (FIGS. 7, 8) the axis of rotation of the pivot 5 extends parallel to the bottom of the depression or articulation area 6.

On a middle portion of the lever element 4, there is supported on the first face 4*a* of the lever 4 an adjustment assembly, indicated at 10, which has, in a preferred embodiment thereof, an actuator body 11 of substantially cylindrical shape defining an actuating knob 12 journalled to a shaft 13 connected to the lever 4 and protruding therefrom in a substantially perpendicular direction.

Rigid with the knob 12, there is provided a groove or pulley 14 which extends circumferentially and laterally to a serration 15 to be better described hereinafter. The pulley 14 operates as a coiler with a coiler axis coinciding with the axis of shaft 13.

Attached to the actuator body 11, advantageously at diametrical points thereon, are the ends of cables 20 which have the other ends connected to the other gaiter, in this embodiment the front gaiter 2.

The attachment points, indicated at 21 in the accompanying drawing, are set apart from the pivot axis defined by the pivot 5, and in this embodiment are located above the axis, thereby, with the lever 4 in the open position access can be had to the adjustment assembly indicated at 10 from the outside.

The cables 20 can be taken up around the groove 14 by acting on the knob 12 to shorten their working lengths and bring the rear gaiter 3 and rear gaiter 2 closer together.

To accomplish this, a pawl lever indicated at 30 acts on the serration 15 and is held elastically in contact with the serration 15.

More in detail, the serration 15 has teeth of sawtooth pattern which have an abutment section 15*a* and a sloping lead-in section 15*b*.

A pawl 31 located at one end of the pawl lever 30 engages with the serration 15 and is adapted to engage with the abutment section 15*a* of one tooth of the serration 15 to block rotation of the actuator body 11 in the paying off direction of the cables 20, and is adapted to "ride the teeth" during the cable take-up stage.

The pawl 30 has, at the remote end from the tooth 31, a grip lug 32 which is actuatable to disengage the pawl 30 from the serration 15, so as to allow the cables to be freely paid off.

The adjustment assembly is then completed by a series of guide elements for the cables 20 which are positioned laterally of the actuator body 11 and comprise advantageously two pairs of juxtaposed rollers 40 which define, laterally of the actuator body 11, a leader groove for the cables 20.

Figure 9:
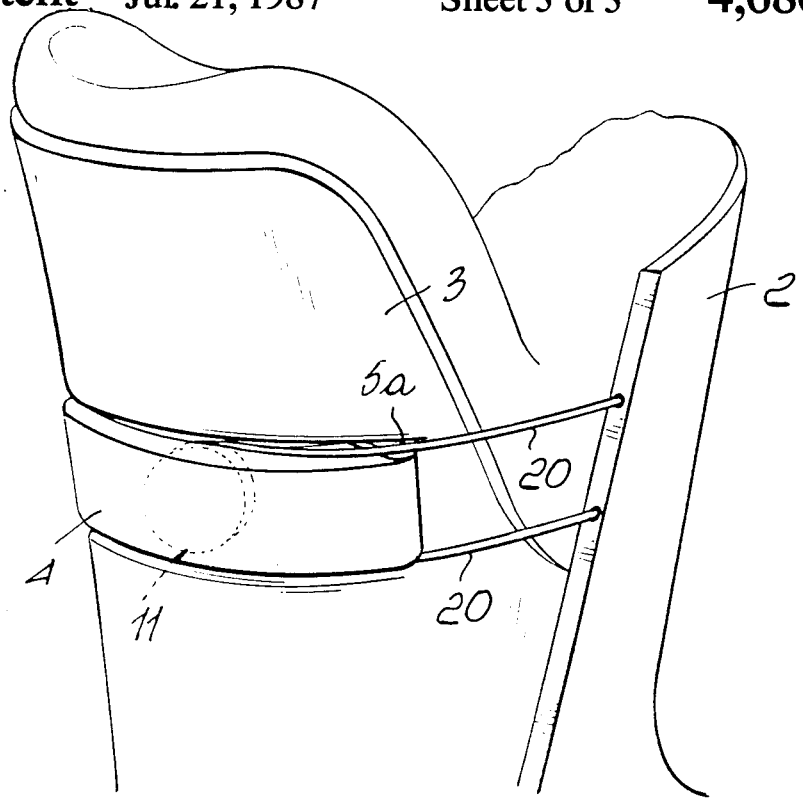
FIG. 9 shows the lever element set with the pivot axis vertically.

According to a further embodiment shown in FIG. 9, the lever 4 is pivoted on a pivot 5*a* which extends longitudinally of the gaiter 3.

Figure 10:
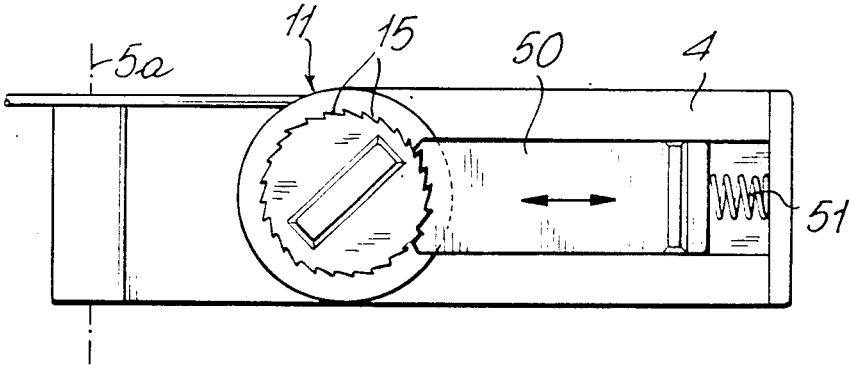
FIG. 10 details a different solution for the means which prevent the cable paying off.

Further in FIG. 10 there are shown different means of implementing the releasable lock of the cable pay-off. In detail here the locking means comprise a toother block 50, slindingly supported on the lever 4 and elastically urged by a spring 51 against the serration 15. To accomplish the disengagement release it will be sufficient to push the block 50 against the bias of the spring 51, here to the right, until the teeth in mutual engagement are disengaged.

In order to bring the gaiters closer together, as previously mentioned, by rotating the knob 12, the cables 20 are wound around the groove 14, shortening their working lengths; that operation may be carried out in a most simple manner because the cables are not tensioned but merely bring the gaiters closer to each other.

Figure 4:
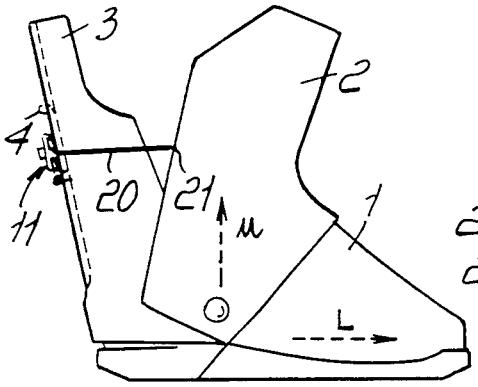
FIG. 4 is a side elevation showing diagrammatically the ski boot in the open position.
Figure 5:
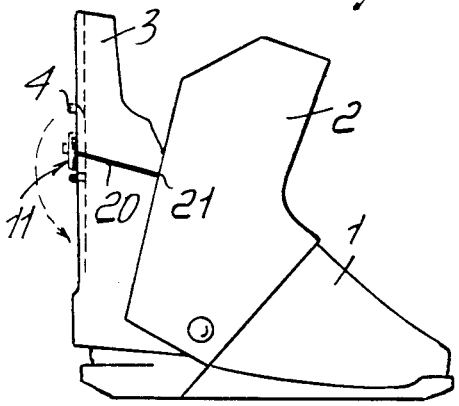
FIG. 5 shows diagrammaticaly the ski boot in the walking position.
Figure 6:
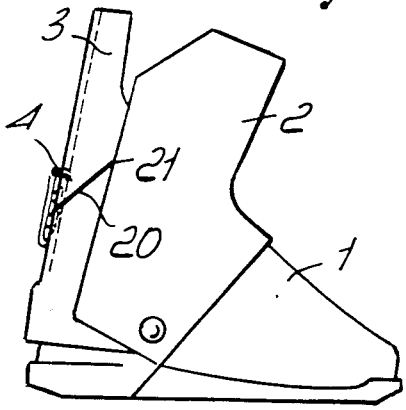
FIG. 6 shows the ski boot in the closed position.

The tightening action at the closing stage is applied by acting on the lever 4 which is rotated about its pivot axis, consisting of the pivot 5, so as to arrange itself in the closed position, preferably remote from the open position (FIGS. 4–6). In this way a significant tightening action can be exerted through the lever element by virtue of the fact that the point of attachment of the cables 20 is set apart from the pivot axis formed by the pivot 5.

By virtue of this tightening solution the adjustment assembly 10 is no longer accessible from the outside, because it is positioned on that face of the lever 4 which is not in view with the lever closed.

In order to open the boot completely, so as to permit the foot to fit in and out, it will be sufficient to turn the lever 4 over to the open position, and to unwind the cables 20 from the groove 14, so as to open the boot and facilitate introduction of the foot.

On completion of the foot introduction stage, the knob 12 is rotated so as to shorten the cable working lengths, bringing the front and rear gaiters closer together, as shown diagrammatically in FIG. 5.

This setting may also be used for walking because it allows the gaiters to be held at a little distance while retaining the foot within the boot.

To carry out the boot tightening it will be sufficient to act on the lever 4, turning it down to the position shown in FIG. 8 so that a pull is applied to the cables with consequent tightening to the desired point between the front and rear gaiters.

In this condition, as already outlined hereinabove, the whole adjustment assembly is "covered" and hidden by the lever, and no incidental shocks are likely to occur which could result in its becoming release. Therefore, the closure device according to the invention is highly safe in use.

To open the boot it will be sufficient to repeat the operations just described in the reverse order. In fact, on opening the lever, there is found an intermediate position where the boot is no longer clamped around the leg and it becomes possible to walk comfortably if desired.

To take the foot out, the cables must be paid off, and to this aim, it is necessary to act on the grip lug 32 of the pawl lever 30 which, by disengaging from the serration 15, enables the actuator body to be turned in the cable paying off direction.

It may be appreciated from the foregoing that a device has been provided wherein the component parts are at all times gathered together, and even with the boot open, no releasing or loss of some closure parts can take place. This is due to the fact that cables 20 are directly and unreleasably connected both to the pulley 11 and to the front gaiter 2.

Advantageously, according to the invention, the actuation of the actuator body to perform the cable taking up is effected with the cables not tensioned, thereby no large effort is required because the gaiter tightening action proper is applied by utilizing the lever element that carries the whole adjustment assembly for adjusting the working length of the cables.

The invention herein is susceptible to many modifications and changes within the inventive concept.

Furthermore, all the details may be replaced with technical equivalents thereof.

In practicing the invention, the material used, so long as compatible with the specific use, and the dimensions and contingent shapes, may be any ones suiting demand.

We claim:

1. In a ski boot defining a longitudinal direction thereof, a widthwise direction thereof and an upwards direction thereof and having a boot shell, attached to the boot shell a first gaiter and a second gaiter opposite to said first gaiter, a gaiter closure device comprising:

a lever member having a fist face on one side thereof and a second face on an opposite side thereof, an articulation area on said first gaiter, articulation means on said articulation area defining an axis of rotation extending substantially parallel to said articulation area, said lever member being articulated on said articulation area by said articulation means rotatable about said axis of rotation from a closing position in which said lever faces said articulation area with said first face thereof to an opening position in which said lever faces said articulation area with said second face thereof, a tension adjusting mechanism having a coiler member arranged on said lever member in an intermediate position thereof and in front of said first face thereof and having a coiling axis extending transverse thereto, cable means having a first portion thereof directly in unreleasable connection with said second gaiter and a second portion thereof directly in unreleasable connection with said coiler member and guide means for said cable means, said coiler member having actuation means conected therewith to operate winding and unwinding of said cable means around said coiler thereby to tension and alternatively slacken said cable means upon actuation of said actuation means.

2. A device according to claim 1, wherein said first gaiter is a rear gaiter and said second gaiter is a front gaiter.

3. A device according to claim 1, wherein said first face of said lever faces outwards when said lever is in said opening position thereof.

4. A device according to claim 1, wherein said coiler has a pulley structure having a circumferential groove receiving said second portion of said cable means, said pulley having a peripheral portion adjacent said circumferential groove and wherein said actuation means comprise a serration at said peripheral portion and a pawl member cooperating therewith and a knob formation for manual actuation of said coiler.

5. A device according to claim 4, wherein said pawl member is in the shape of a pawl lever having a pawl tooth on one end thereof and a grip lug on the opposite end thereof for actuation of said pawl member.

6. A device according to claim 4, wherein said pawl member is in the form of a spring biased slidable toothed block member cooperating with said serration.

7. A device according to claim 1, wherein said axis of rotation of said lever extends perpendicular to the longitudinal direction of said ski boot.

8. A device according to claim 1, wherein said axis of rotation extends parallel to said widthwise direction.

9. A device according to claim 1, wherein said axis of rotation extends parallel to said upwards direction.

10. A device according to claim 1, wherein said guide means comprise guiding rollers arranged laterally to said coiler and in guiding engagement with said cable means.

11. In a ski boot defining a longitudinal direction thereof, a widthwise direction thereof and an upwards direction thereof and having a boot shell, attached to the boot shell a rear gaiter and a front gaiter opposite to said rear gaiter, a gaiter closure device comprising:

a lever member having a fist face on one side thereof and a second face on an opposite side thereof, an articulation area on said first gaiter, articulation means on said articulation area defining an axis of rotation extending substantially parallel to said articulation area, said lever member being articulated on said articulation area by said articulation means rotatable about said axis of rotation from a closing position in which said lever faces said articulation area with said first face thereof to an opening position in which said lever faces said articulation area with said second face thereof, a tension adjusting mechanism having a coiler member arranged on said lever member in an intermediate position thereof and in front of said first face thereof and having a coiling axis extending transverse thereto, cable means having a first portion thereof directly in unreleasable connection with said second gaiter and a second portion thereof directly in unreleasable connection with said coiler member and guide means for said cable means, said coiler member having actuation means conected therewith to operate winding and unwinding of said cable means around said coiler thereby to tension and alternatively slacken said cable means upon actuation of said actuation means, wherein said coiler has a pulley structure having a circumferential groove receiving said second portion of said cable means, said pulley having a peripheral portion adjacent said circumferential groove and wherein said actuation means comprise a serration at said peripheral portion and a pawl member cooperating therewith and a knob formation for manual actuation of said coiler.

12. A device according to claim 11, wherein said pawl member is in the shape of a pawl lever having a pawl tooth on one end thereof and a grip lug on the opposite end thereof for actuation of said pawl member.

13. A device according to claim 11, wherein said pawl member is in the form of a spring biased slidable toothed block member cooperating with said serration.

14. A device according to claim 11, wherein said axis of rotation of said lever extends perpendicular to the longitudinal direction of said ski boot.

15. A device according to claim 11, wherein said axis of rotation extends parallel to said widthwise direction.

16. A device according to claim 11, wherein said axis of rotation extends parallel to said upwards direction.

17. A device according to claim 11, wherein said guide means comprise guiding rollers arranged laterally to said coiler and in guiding engagement with said cable means.

* * * * *